US007934563B2

(12) United States Patent
Oglesby

(10) Patent No.: US 7,934,563 B2
(45) Date of Patent: May 3, 2011

(54) INVERTED DRAINHOLES AND THE METHOD FOR PRODUCING FROM INVERTED DRAINHOLES

(75) Inventor: Kenneth Doyle Oglesby, Tulsa, OK (US)

(73) Assignee: Regency Technologies LLC, Tulsa, OK (US)

( * ) Notice: Subject to any disclaimer, the term of this patent is extended or adjusted under 35 U.S.C. 154(b) by 145 days.

(21) Appl. No.: 12/362,620

(22) Filed: Jan. 30, 2009

(65) Prior Publication Data

US 2009/0194292 A1 Aug. 6, 2009

Related U.S. Application Data

(60) Provisional application No. 61/063,323, filed on Feb. 2, 2008.

(51) Int. Cl.
*E21B 43/00* (2006.01)
*E21B 7/08* (2006.01)
*E21B 4/00* (2006.01)

(52) U.S. Cl. ..... 166/369; 166/50; 166/117.5; 175/61; 175/94

(58) Field of Classification Search ..... 166/313, 166/50, 117.5, 117.6; 175/61, 94
See application file for complete search history.

(56) References Cited

U.S. PATENT DOCUMENTS 2,404,341 A 7/1946 Zublin
2,857,002 A * 10/1958 Pevere et al. ..... 166/303
3,386,508 A * 6/1968 Bielstein et al. ..... 166/272.3
4,396,075 A 8/1983 Wood et al.
4,402,551 A 9/1983 Wood et al.
4,415,205 A 11/1983 Rehm et al.
4,421,183 A 12/1983 Collins, Jr.
4,431,069 A 2/1984 Dickinson, III et al.
4,501,337 A 2/1985 Dickinson, III
4,605,076 A 8/1986 Goodhart
4,646,835 A 3/1987 Watkins et al.
4,646,836 A 3/1987 Goodhart
4,753,485 A * 6/1988 Goodhart ..... 299/5
4,852,666 A * 8/1989 Brunet et al. ..... 175/61
4,945,994 A 8/1990 Stagg
5,010,764 A 4/1991 Taylor
5,029,641 A 7/1991 Stagg
5,115,872 A * 5/1992 Brunet et al. ..... 175/61
5,511,616 A * 4/1996 Bert ..... 166/272.7
6,325,164 B1 12/2001 Bayer
6,360,821 B1 3/2002 Braddick
6,464,002 B1 10/2002 Hart et al.
6,695,056 B2 2/2004 Haugen et al.
6,719,045 B2 4/2004 Hart et al.
6,843,314 B2 1/2005 Toulouse et al.
6,968,903 B2 11/2005 Pollard
7,124,827 B2 10/2006 Braddick
2009/0194292 A1 * 8/2009 Oglesby ..... 166/369

* cited by examiner

*Primary Examiner* — Jennifer H Gay
(74) *Attorney, Agent, or Firm* — Head, Johnson & Kachigian, P.C.

(57) ABSTRACT

A method and apparatus for creating inverted laterals or drainholes for producing from a subterranean reservoir including the steps of lowering, positioning and securing a reverse whipstock in a wellbore. A tube is secured from the surface to a pull tube which extends through and below the reverse whipstock. Fluid is pumped from the surface and through a U-tube device below the pull tube. At least one inverted drainhole is drilled using force from the pumping fluid. The pull tube is pulled upward vertically toward the surface while pumping the fluid.

8 Claims, 5 Drawing Sheets

110
117
117
116
114
115

113
114
115
SECTION B-B

B
116
B 116
115
114

INVERTED DRAINHOLES AND THE METHOD FOR PRODUCING FROM INVERTED DRAINHOLES

CROSS-REFERENCE TO RELATED APPLICATIONS

This application claims the benefit of U.S. provisional Ser. No. 61/063,323 filed Feb. 2, 2008.

BACKGROUND OF THE INVENTION

1. Field of the Invention

The present application relates generally to an improved method for producing hydrocarbons from a reservoir. More particularly, the subject invention concerns the creation of an inverted drainhole having an inverted or upwardly inclining bore into a producing interval starting from a generally vertical wellbore which extends from the surface and a method for drilling, completing, and producing utilizing such an inverted drainhole.

2. Prior Art

A conventional method to produce hydrocarbons has been to drill a wellbore in an essentially vertical direction from the surface through a subterranean reservoir using standard bits, motors and drill pipe. In reservoirs that are relatively thin, this method exposed only a small portion of the pay zone, or producing formation, to the wellbore, and thus limits productivity. Also premature gas coning and/or water coning in such wells often reduced the amount of oil or gas that could be recovered. Coning is a formation phenomena in which the contact (or interface) between a layer of oil and either water or gas assumes a peculiarly cone shape and thereby allows early production of the offending fluids and reduces the amount of valuable oil or gas available to be produced.

Within the past decade, it has become increasingly common to drill at least a portion of the wellbore so that it intersects the reservoir from the top and at a high angle off vertical. In some cases this is a high angle of from 83 to about 88 degrees off vertical, or even horizontal (90 degrees off vertical). High angle or horizontal sections can then be extended laterally from the top through the pay zone by 1000 to 3000 feet or more, or through a plurality of pay zones which may be separated by fault blocks, shale stringers, or other barriers to horizontal or vertical permeability. Development of high angle drilling techniques has meant that more of the pay zone can be exposed to the wellbore, and that oil or gas can be produced at a faster rate while potentially recovering more of the original oil in place than would be otherwise possible with a conventional vertical or even directional well (less than 83 degrees off vertical). This is generally called "directional drilling" or "horizontal drilling". The standard equipment utilized to drill these conventional laterals includes—a whipstock, bits, motors, bent subs, monel pipe, gyroscopes and other directional tools.

Prior attempts to install lateral boreholes in a well include Collins, Jr (U.S. Pat. No. 4,421,183) which discloses an apparatus for penetrating the sidewalls of boreholes. Other efforts include U.S. Pat. Nos. 2,404,341, 4,396,075, 4,402,551 and 4,415,205.

Current directional drilling methods and equipment can install lateral or directional laterals or drainholes that are important to relieve pressure in the formation and increase production of the oil or gas product. These direction laterals or drainholes exit the mostly vertical wellbore at a generally downward vertical angle and then out to increasing angles as the depth is increased. Thus the entrance vertical point is higher in elevation than the formation target. Even the end point of the lateral or drainhole is generally the lowest point of the full lateral or drainhole. The curvature to get these laterals from vertical to horizontal can be 90 feet radii to several hundred feet radii. This radius is kept so high to allow the drill equipment to function, to allow production pumps to be run through the curve section and installed in the bottom level or to run certain tools to the end of the lateral. Pumps must be run through the curve section to pump the well's fluid from the lowest point possible to maximize productivity. However, significant problems occur in running pumps through this long curved section—including rod wear, stuck tools, smaller pumps. Also such a long radius means that the curve must be started higher up the hole starting in rocks or formations that are difficult and/or expensive to drill. Also, such long curves mean that it takes longer to drill and adding length to the drilled section.

Of course, may variations can occur, including increasing the upward angle toward the end of the lateral. Another problem with current directional drilling practices is that solids from the formation and from the drilling, production and/or completion process or other from sources can build up in the lowest part of the lateral section and cannot be lifted up and out of the well by production fluids to clear the installed lateral. This can reduce, stop or interfere with production.

Another problem with current directional or horizontal drilling practices is that liquids also can build up in the lateral in the lowest points and cannot be cleaned out in normal flow processes. Such liquid buildup can cause an increased liquid saturation in the surrounding formation rock at the lowest point of the laterals and prevent gaseous flow due to backpressure, relative permeability reduction or capillary pressure restrictions.

Other problems with current directional or horizontal drilling practices is the requirement of putting force or "weight on bit" on the bit so that the rock can be crushed, cut and ground up. Also the rotational requirement for the bit requires significant additional effort and increased wear in shorter radii turns.

An inverted lateral or drainhole, that is one that is not drilled in a generally downward direction, but is drilled in a generally upward direction from the primary mostly vertical wellbore such that it is slanted upward and outwards into the formation and would encourage liquids to drain out of the lateral or drainhole, and solids to flow out with liquid flow and/or for gas saturation to remain in the lateral drainhole to maximize gas flow. Previous art in this area includes U.S. Pat. No. 4,431,069 Dickinson and U.S. Pat. Nos. 4,605,076/4, 646,835 Goodhart. That existing art utilized standard drilling tools including bits and motors and required rotation of the full or part of the drill pipe. Such an reverse drainhole arrangement would allow a pump to be placed in the generally vertical primary well bore below the intersections or exit points of the inverted laterals. This would allow a larger pump that could be easily repaired and that can service several or many inverted laterals or drainholes.

The creation of such inverted laterals or drainholes has not been described or utilized in the prior art and is needed to address the limitations of existing drainhole or horizontal lateral technology.

SUMMARY OF THE INVENTION

The problems and needs discussed above are addressed by the instant invention. One aspect of the instant invention is, then, a method to install a drainhole or directional drain hole or directional lateral such that the mostly vertical wellbore exit point is below the formation/rock entrance point which is below all other locations, including the end point, of the lateral or drainhole in the targeted formation.

Another aspect of the instant invention is a diverter tool, or reverse whipstock, that has an inverted angled wedge to force a cutting tool into the well casing and into a formation in an upward and outward stroke or direction.

Another aspect of the instant invention is a reverse whipstock that can be attached to the well formation or casing by a packer, anchor, spring or other similar tool.

Another aspect of the instant invention is a reverse whipstock that it is not attached to the well formation or casing, but is instead attached to a tubing string that normally goes from the whipstock to the surface.

Another aspect of the instant invention is a deep U-tube connector attached to a pull tube and to a drilling tube below the reverse whipstock. The U-tube connector may or may not have rollers on each side for reducing friction and tilting effects. The U-tube connector allows the transfer of movement and fluid flow from one string or tube to a parallel string or tube.

Another aspect of the instant invention is a reverse whipstock that has one full bore through it and one partial bore ending in a wedge within it.

Another aspect of the instant invention is a reverse whipstock that has two paths—one pull tube (in tension during the drilling process) fully through it and one drill tube (in compression during the drilling) partially through it during the installation process of the inverted lateral or drainhole. At the top of the path for the drill tube is a hardened wedge that forces the drill tube outward as it is pushed upward. This reverse whipstock is attached on the top to a device that will position it in place and keep it stationary during the drilling process. That device can be tubing, spring, tubing anchor or packer that is tubing or wireline set (mechanical or hydraulic set).

Another aspect of the instant invention is pipes or tubes connected to the top of the pull tube and used in the process for drilling fluid flow, pressure and movement/force to the cutting tip that are either jointed or continuous coiled tubing.

Another aspect of the instant invention is that rock cuttings formed during the drilling process flow downward in the lateral or drainhole, into the generally vertical primary wellbore. These rock cuttings or solids may then travel upward through ports in the reserve whipstock or diverter tool, then to the surface through the casing or tubing.

Another aspect of the instant invention is a tubular string (jointed or coiled) that runs from the surface and connects to the top of the pull string above the reverse whipstock. Fluid flow also occurs through and down this tubular string and into the pulling tube, then through the U-tube connector then through the drill tube and out the cutting tip.

Another aspect of the instant invention is that the formation liquid flow direction is generally downward from the inverted lateral or drainhole into the generally vertical well bore.

Another aspect of the instant invention is that the drillstring is not rotated during the drilling process and minimal force is needed to continue the drilling process.

Another aspect of the instant invention is that high energy advanced drilling processes (such as water jetting, abrasive water jetting, abrasive slurry jetting, FLASH drilling systems, cavitation, plasma or laser systems) are utilized to cut the rock and steel ahead of the drill tip. In these advanced processes low contact with the rock ahead of the Drill Tip is required or needed. Also only sell or internal rotation means, if any, are required and not the complete or a segment of the drill string.

Another aspect of the instant invention is a device for drilling in which a surface pulling or tension force is transmitted to a deep drilling device (for example, a cutting tip) causing an upward drilling force on the drilling device, which is then forced upward and outward into the formation.

Another aspect of this instant invention is the use of such an inverted drilling device beginning and exiting out of a mostly directional or horizontal primary wellbore. In this case, the upward pull is axial to the primary wellbore and toward the surface end. The exit point begins in this direction and turns outward from the primary wellbore as the process progresses. The true ultimate direction of the drainhole will depend on the exit point direction, hole size and gravity.

Another aspect of the instant invention is the creation of multiple inverted drainholes out of the same primary (vertical or otherwise) wellbore. These can be arranged as spokes on a wheel at the same depth but in different directions or angles. Alternatively, they can also be at different depths.

Another aspect of the instant invention once installed is that formation-produced, injected, or process formed gases can, if desired, remain in the upper section of the inverted lateral or drain hole to maintain a gaseous saturation in the formation rock near the lateral or drainhole. This can increase productivity of the well.

Another aspect of the instant invention once installed is that formation produced liquids can be fully drained out of the inverted drainholes into the generally vertical primary wellbore and produced to the surface, thereby allowing produced gases to flow freely to the surface. This can also increase the productivity of the well.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
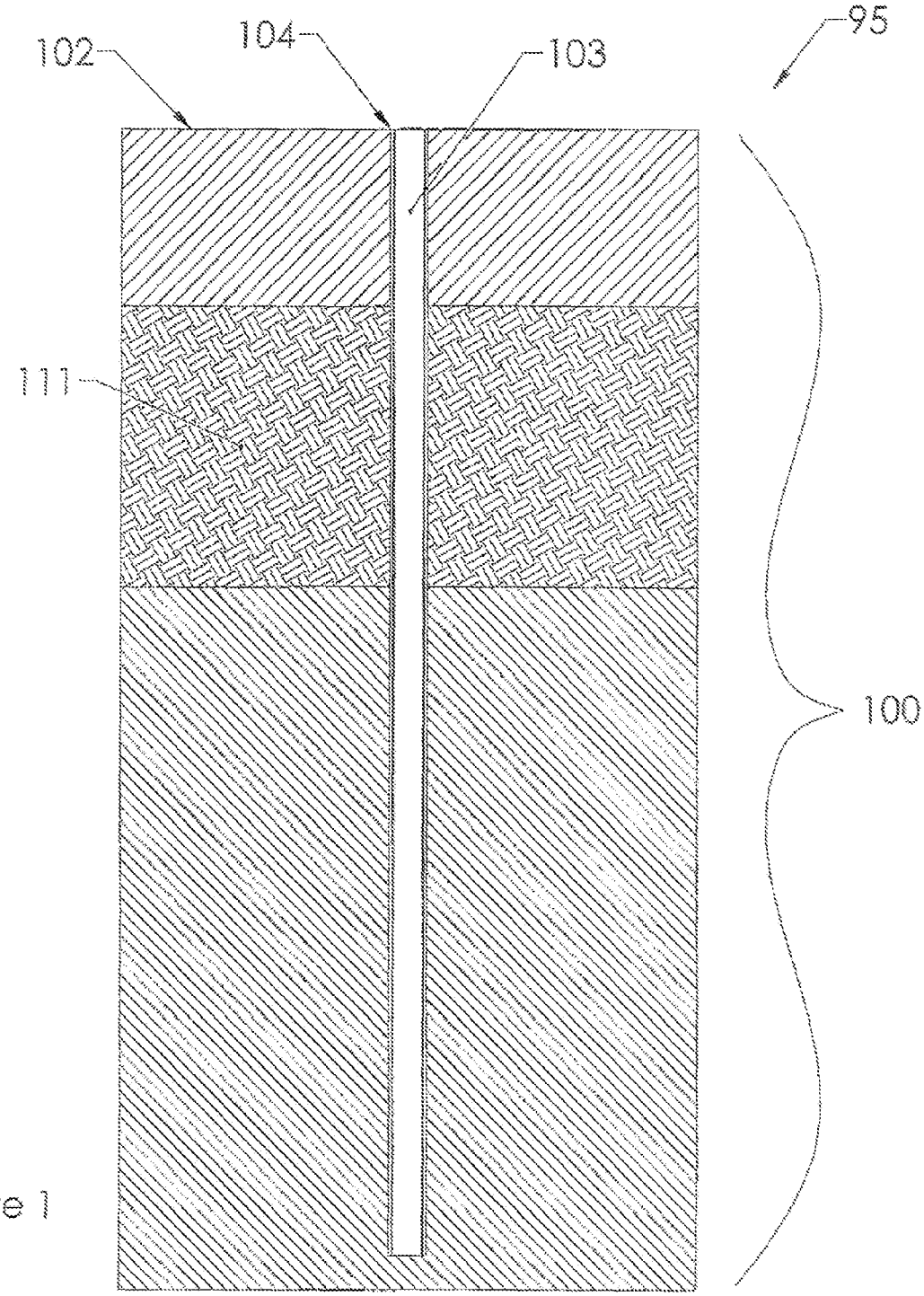
FIG. 1 is a side cross section of a subterranean well showing a generally vertical wellbore drilled from the surface through rock formations, including a productive formation prior to introduction of the present invention.

FIG. 1, shown by the numeral 95, shows a generally vertical wellbore 103 drilled from a surface 102 through one or more rock formations 100, and specifically through a productive formation 111, with a vertical wellbore steel casing 104 in the wellbore. Contact of this primary wellbore to the productive formation is thus the thickness or depth of the productive formation 111 (top to bottom) only. FIG. 1 illustrates a typical subterranean well prior to introduction of the present invention.

Hydrocarbons may be extracted from the productive formation 111 in various well known manners.

Figure 2:
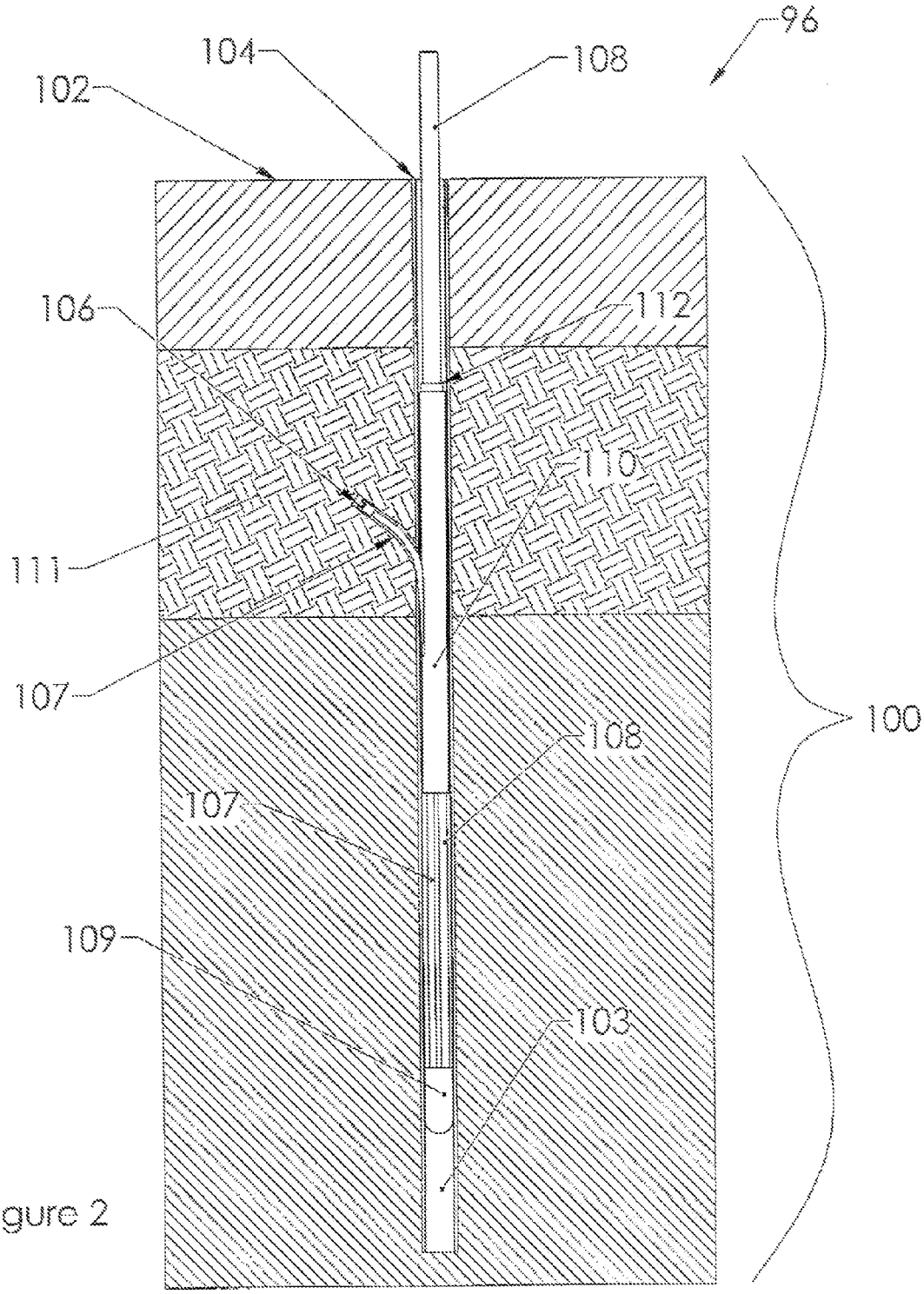
FIG. 2 is a side cross-section of a well and rock formations showing the beginning of the process of installation an inverted lateral or drainhole into the productive formation as set forth in the present invention.

FIG. 2, shown generally by the numeral 96, shows the beginning of the process of installation of an inverted drainhole 106 out of and extending from the generally vertical primary wellbore 103. This process requires lowering and positioning a reverse whipstock 110 in the vertical well at (or optionally below) the lower section of the productive formation 111. In one non-limiting option, the reverse whipstock 110 is held in place by an standard oilfield anchor 112 to the well casing 104. A Drill Tip connects to the top end of a Drill Tube 107 (considered collectively), which is then connected to a bottom U-Tube 109. A Pull Tube 108 extends through an opening in the reverse whipstock 110 and is connected on top to tubing that extends to the surface 102. The Pull Tube 108 is capable of vertical movement and pulls up the U-Tube 109 as the inverted drainhole is created.

Various types of fluids may be used as the motive force including gas, liquid or super critical fluids. In addition, abrasive solids may be added to the fluids for enhanced cutting. Electrical power lines, not shown in this version, can be supplied to the Drilling Tip from the surface. These methods do not require rotation of the full or any significant portion of the drill string.

Fluid is pumped from the surface 102 down the tubing connected to the Pull Tube 108, through the U-Tube 109 which reverses direction of the fluid, up the Drill Tube 107 and through the Drill Tip. The fluid flow is utilized to create or evacuate the rock ahead of the Drill Tip and it also helps clean the drainhole as it is drilled. The Drill Tipat the top end of the Drill Tube 107 starts in the reverse whipstock 110 in a channel that ends in a wedge that forces the Drill Tip and Drill Tube 106 outwardly as the Pull Tube 108 is pulled upwards from the surface 102 and fluid is pumped down Pull Tube 108. These actions cause drill solids or cuttings to be carried down and out the drainhole 106 as the rock formation 111 is cut and evacutated and into vertical well bore 103. Such cuttings can then be carried up the vertical wellbore 103 to the surface 102 via installed tubing or casing.

Figure 3:
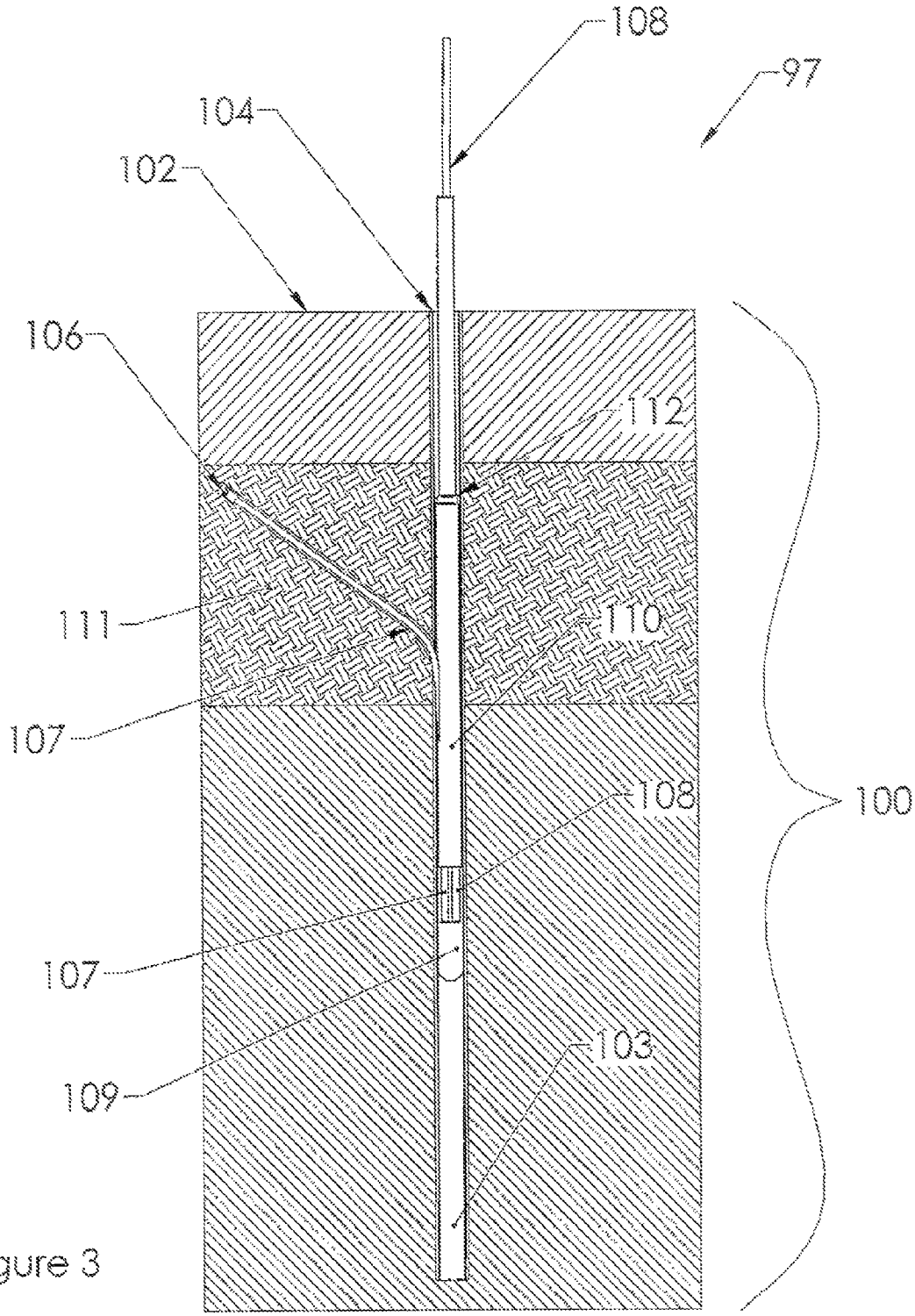
FIG. 3 is a side cross-section of a well and rock formations showing the endpoint of the process of installation of an inverted lateral or drainhole.

FIG. 3, shown generally by the numeral 97, shows the inverted drainhole 106 now fully installed from the lower exit point of the generally vertical wellbore 103, out the well casing 104 and to the top of the productive formation 111. The distance of the extension of the installed inverted drainhole 106 is directly related to the amount of vertical wellbore 103 below the productive formation 111, also known as a "Rat Hole". Such extension is also directly related to the length of the Drill and Pull Tubes utilized in the process.

After final installation of the inverted drainhole 106, the Pull Tube 108 is pushed downward by the weight of the surface tubing, which pushes the U-Tube 109 downward which pulls the Drill Tubend Drill Tip out of the inverted drainhole and back into the reverse whipstock 110. A stop or diameter restriction (not shown) prevents the Drill Tip from dropping below the reverse whipstock 110. With all equipment out of the drainhole, the reverse whipstock 110 can be repositioned in the vertical wellbore 103 for additional drainhole installations or can be fully pulled out of or retracted from the wellbore 103.

Figure 4:
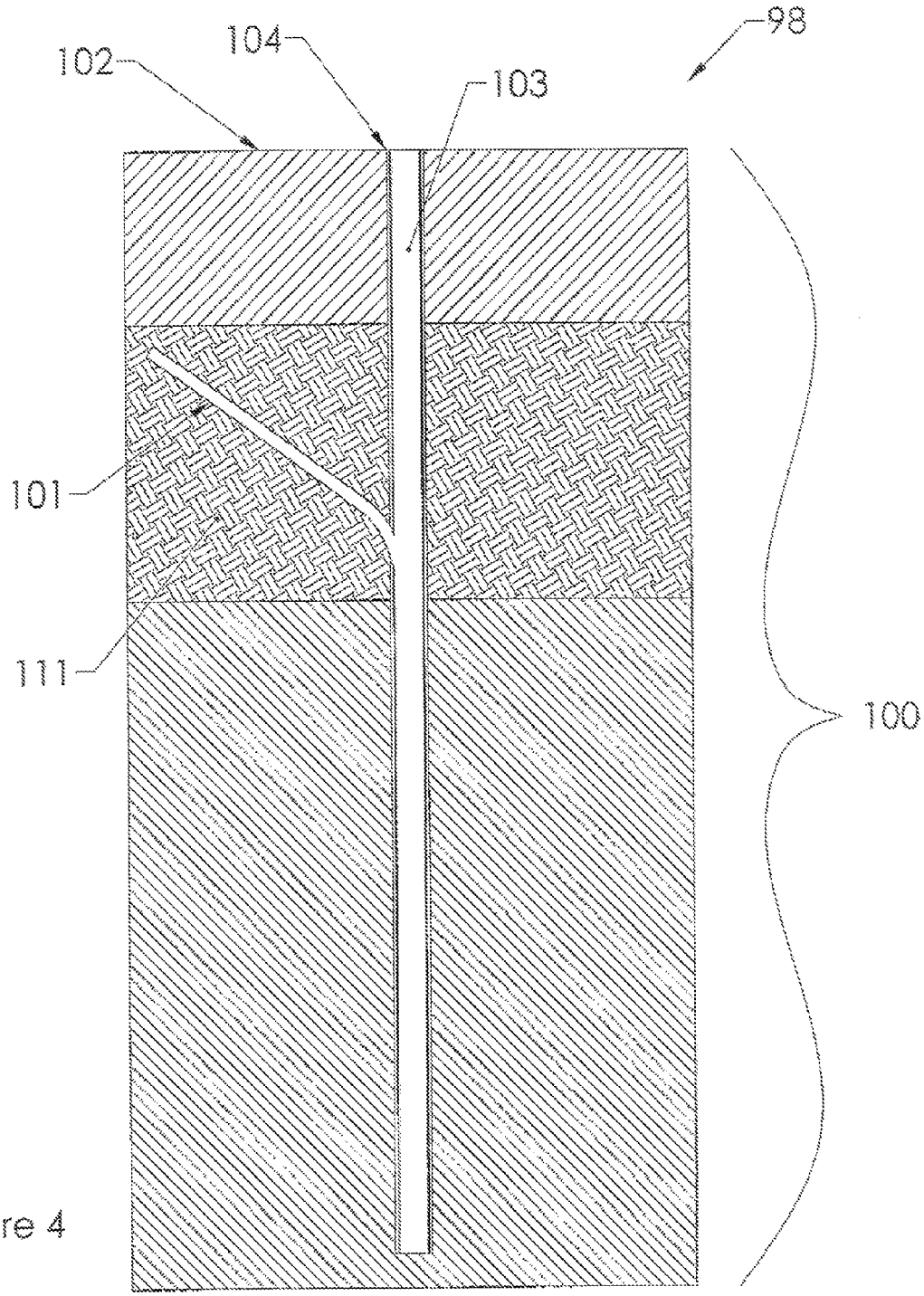
FIG. 4 is a side cross-section of a well and rock formations showing a fully installed inverted lateral or drainhole in the productive formation.

FIG. 4, shown generally by the numeral 98, shows all of the installation equipment pulled out of the well after installing the inverted drainhole 101, out of vertical wellbore 103 and into productive formation 111. After removal of such installation and drilling equipment, known production tubing and pumps (not shown) can be run in the vertical well and installed at a point below the exit point(s) of the inverted drainhole(s) 101. This allows all liquid to be removed from the drainhole(s) 101 if desired.

Products such as hydrocarbons may thereafter be produced.

Figures 5A, 5B, 5C, 5D:
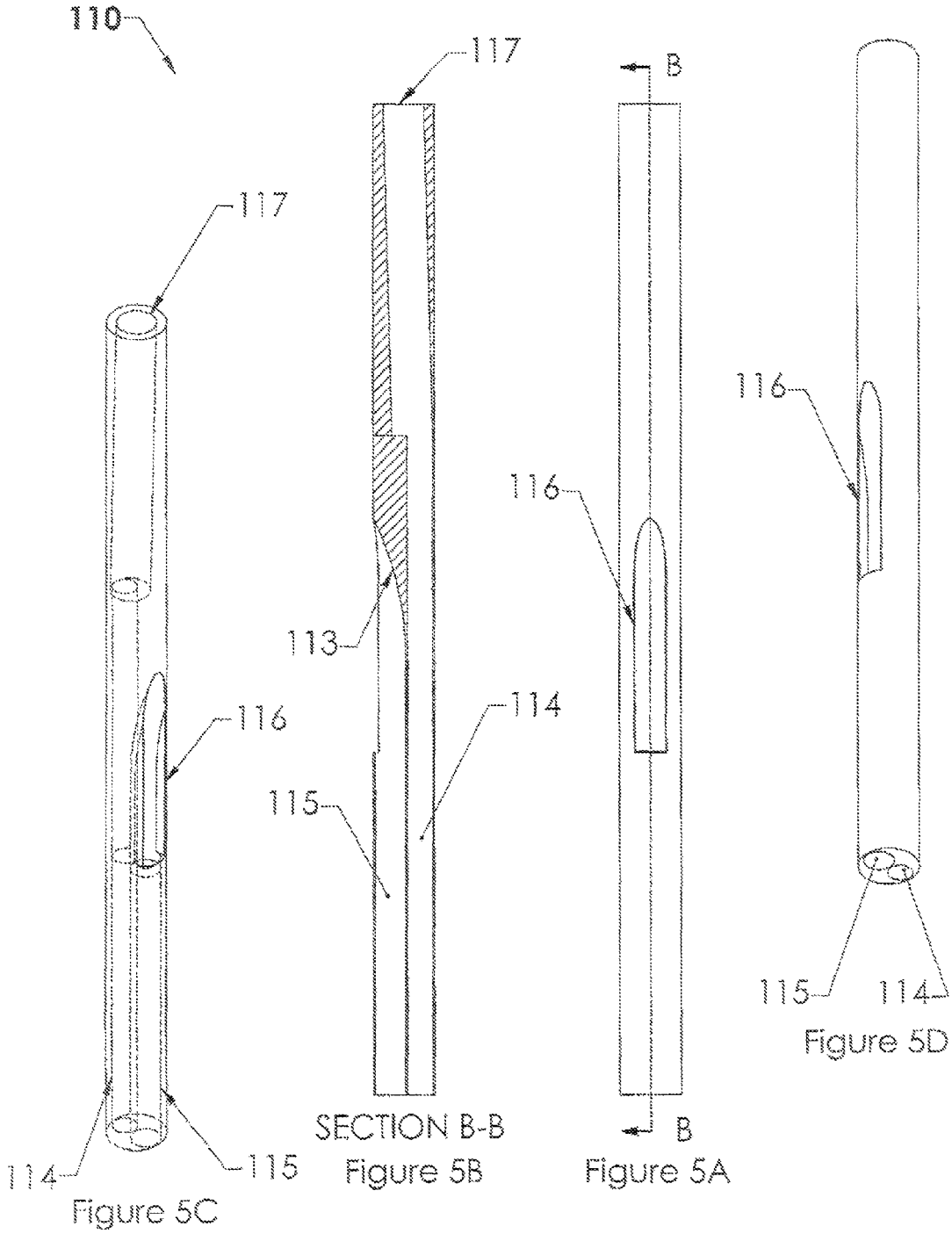
FIGS. 5A, 5B, 5C and 5D show several alternate views of a reverse whipstock or diverter tool used in the process of creating and installating an inverted lateral or drainhole.

FIG. 5 illustrates several different views of one reverse whipstock assembly 110. A Pull Tube 108 extends through the reverse whipstock 110 with a wider bore section 117 at the top and a smaller bore section 114 at the bottom, then extends down to connect with a U-Tube (shown as element 109 in FIG. 2). Pathway 115 is for the Drill Tube and begins at the bottom of the reverse whipstock and extends up to the open window section 116 ending with the angled surface 113 in the mid section of the reverse whipstock. The Drill Tip and Drill Tube begins in this channel 115, 116 before its upward and outward movement at curve section or angled surface 113.

When the system is run in the well, the reverse whipstock assembly can be attached to a larger tubing, with or without a swivel, anchor or other such positioning devices. The Drill Tip 106 at the top of the Drill Tube 107 begins in 116, below 113 and extends out below 115. The Drill Tube 107 continues below and is attached to the U-Tube 109. The Pull Tube is attached to the other top half of the U-Tube and extends upward through the reverse whipstock channel bores 114 and 117 and on upward where it is connected to the surface 102.

In one non-limiting example, in practice, an inverted lateral drainhole can be installed as follows. First, a generally vertical well bore of sufficient diameter and depth is drilled. This can be and normally is a completely separate operation to the installation process of the inverted laterals. The internal diameter of the vertical well bore must be sufficient to contain the parallel Pull 108 and Drilling 107 tubes and the reverse whipstock assembly 110 and U-Tube connector 109. The depth should be sufficiently deeper than the targeted formation to match the distance out from the well that is desired in the inverted lateral.

The next step in the process is to run either a gamma ray and/or magnetic casing collar locator or collar location logs. A casing collar locator is a known downhole tool used to confirm or correlate treatment depth using known reference points on a casing string. The casing collar locator is an electric logging tool that detects the magnetic anomaly caused by the relatively high mass of each casing collar. A signal is transmitted to surface equipment that provides a screen display and printed log enabling the output to be correlated with previous logs and known casing features such as pup joints installed for correlation purposes. A gamma-ray logging device measures the natural radioactivity of the surrounding rock to correlate the targeted formation depth. Surface readout is also normal with this device. Both the collar locator and the gamma ray devices are then cross correlated to match formation target depth with referenced collar depths.

The next step is to connect the bottom U-Tube 109 connector with the Drill Tube 107 and Pull Tube 108 concurrently. Both pull and drill tube lengths must be as long as the desired inverted lateral or drainhole.

The next step is to join the Drill Tube 107 with the Drill Tip 106 desired and install them inside the reverse whipstock assembly 110 below the embedded wedge. Then the pull tube is run through the reverse whipstock assembly such that it is sticking above the reverse whipstock assembly. Then a standard oilfield "J slot" type sealing connector is installed on top of the Pull Tube 108 so that a surface tube can connect to it and provide an upward/downward force and seal for fluid flow and pressure. In one non-limiting example, a packer or anchor is connected to the top of the reverse whipstock to position and hold it in position in the wellbore.

All of the above-described assembly would then be run in the well on wireline or on tubing and set in place in the lower section of or below the targeted productive formation 111.

Alternately, larger tubing can be used to hold the reverse whipstock in place, with or without a packer or anchor. Said larger tubing can be released and pulled out of the well or can remain attached. Any larger tubing that remains attached can be connected on the bottom to a swivel 112 and/or a tubing anchor or packer 112.

Once at proper depth and set in position, a smaller tubular or pipe is run (inside the larger tubing if utilized) and connects with and seals to the top of the Pull Tube 108 with standard industry methods (such as seals, slips, or "J" slot type connection). Such a connection provides a mechanism or means to transmit force, flow and pressure between the pipes to the Drill Tip 106. Flow is initiated at the surface, down the smaller surface tube, through the Pull Tube 108, through the U-Tube 109 and through the Drill Tube 107 and out the Drill Tip 106. This flow starts the cutting process of the steel casing 104 and then the formation rock 111 at the Drill Tip 106. An upward pull on the smaller surface tube at the surface will transmit an upward force on the Drill Tip 106 onto the wedge surface 113 inside the reverse whipstock. This will cause the Drill Tip 106 to cut further and further out the vertical wellbore as the pipe is pulled. Gravity exerts a force to gradually level off the upward trajectory. Also, just stopping or slowing the pulling movement and allow the Drill Tip 106 to cut a larger hole, the trajectory will level off the upward direction toward horizontal much faster.

While one or more embodiments of this invention have been illustrated in the accompanying drawings and described above, it will be evident to those skilled in the art that changes and modifications may be made therein without departing from the essence of this invention. All such modifications or variations are believed to be within the sphere and scope of the invention as defined by the claims appended hereto.

Whereas, the present invention has been described in relation to the drawings attached hereto, it should be understood that other and further modifications, apart from those shown or suggested herein, may be made within the spirit and scope of this invention.

What is claimed is:

1. A method for producing products from a subterranean reservoir from an existing generally vertical wellbore, the method comprising the steps of:

lowering, positioning and securing a reverse whipstock in said wellbore;

securing a tube from the surface to a pull tube which extends above, through and below the reverse whipstock;

pumping fluid from the surface through said tube from the surface and through a U-tube device below said pull tube and said reverse whipstock;

drilling at least one inverted drainhole with a drill mechanism using force from said pumping fluid, wherein the drilling direction for the drainhole is less than 90 degrees from vertical pulling said pull tube upward vertically toward the surface while pumping said fluid;

completing the wellbore and said inverted drainhole to form a producing flow path to allow fluids and solids to flow by gravity from the subterranean reservoir into the wellbore;

lowering said pull tube in order to lower said drill mechanism out of said inverted drainhole to permit removal from said wellbores; and allowing said fluids and solids to flow or be pumped to the earth's surface up the wellbore.

2. The method as set forth in claim 1 including holding said reverse whipstock in the wellbore with an anchor device affixed to a well casing.

3. The method as set forth in claim 1 including holding said reverse whipstock in the well bore utilizing tubes or pipes from the surface to said reverse whipstock.

4. The method as set forth in claim 1 including multiple of the at least one inverted drainholes created out of the vertical well bore.

5. The method as set forth in claim 1 wherein said step of pumping fluid from the surface includes fluid chosen from a group consisting of gas, liquid and super critical fluids.

6. The method as set forth in claim 1 wherein said step of drilling at least one inverted drainhole is chosen from the group consisting of waterjetting, abrasive water jetting, abrasive slurry jetting, FLASH ASJ cutting and drilling, and cavitation, laser, or plasma methods.

7. An apparatus for creating inverted lateral drainholes which comprises:

a first tube extending downhole from a surface;

a reverse whipstock, wherein said first tube extends through said reverse whipstock;

a U-tube device having a first end connected to and in fluid communication with said first tube;

a second tube connected to and in fluid communication with an opposed end of said U-tube;

a drill mechanism powered by force from pumping fluid through said first tube, through said U-tube, and through said second tube; and means for raise and lower said drill mechanism from the surface.

8. A method for producing products from a subterranean reservoir from an existing wellbore, the method comprising the steps of:

lowering, positioning and securing a reverse whipstock in-said wellbore;

securing a tube from the surface to a pull tube which extends above, through and below the reverse whipstock;

pumping fluid from the surface through said tube from the surface and through a U-tube device below said pull tube and said reverse whipstock;

drilling at least one inverted drainhole with a drill mechanism using force from said pumping fluid, wherein the drilling direction for the drainhole is less than 90 degrees from said existing wellbore;

pulling said pull tube upward vertically toward the surface while pumping fluid;

completing the wellbore and said inverted drainhole to form a producing flow path to allow fluids and solids to flow by gravity from the subterranean reservoir into the wellbore;

lowering said pull tube in order to lower said drill mechanism out of said inverted drainhole to permit removal from said wellbores; and allowing said fluids and solids to flow or be pumped to the earth's surface up the wellbore.

* * * * *